US007118331B2

(12) United States Patent
Shahpar

(10) Patent No.: US 7,118,331 B2
(45) Date of Patent: Oct. 10, 2006

(54) STATOR VANE ASSEMBLY FOR A TURBOMACHINE

(75) Inventor: Shahrokh Shahpar, Derby (GB)

(73) Assignee: Rolls-Royce plc, London (GB)

( * ) Notice: Subject to any disclaimer, the term of this patent is extended or adjusted under 35 U.S.C. 154(b) by 154 days.

(21) Appl. No.: 10/831,155

(22) Filed: Apr. 26, 2004

(65) Prior Publication Data

US 2004/0234372 A1 Nov. 25, 2004

(30) Foreign Application Priority Data

May 14, 2003 (GB) ..... 0311025.1

(51) Int. Cl.
*F01D 9/00* (2006.01)

(52) U.S. Cl. ..... 415/195; 415/209.1; 416/203

(58) Field of Classification Search ..... 415/195, 415/194, 193, 209.1; 416/203, 175, 198 A
See application file for complete search history.

(56) References Cited

U.S. PATENT DOCUMENTS 4,558,987 A 12/1985 Dittie
6,139,259 A * 10/2000 Ho et al. ..... 415/119
6,386,830 B1 5/2002 Slipper et al.
6,439,838 B1 * 8/2002 Crall et al. ..... 415/119
6,540,478 B1 * 4/2003 Fiala et al. ..... 415/194
2003/0115885 A1 * 6/2003 MacFarlane et al. ..... 60/793

FOREIGN PATENT DOCUMENTS

| | | |
|---|---|---|
| EP | 942150 A | 9/1999 |
| GB | 695948 P | 8/1953 |
| GB | 1291235 P | 10/1972 |
| GB | 2046849 A | 11/1980 |
| WO | WO 01415 A | 1/1993 |

* cited by examiner

*Primary Examiner*—Edward K. Look
*Assistant Examiner*—Richard A. Edgar
(74) *Attorney, Agent, or Firm*—W. Warren Taltavull; Manelli Denison & Selter PLLC

(57) ABSTRACT

A stator vane assembly for a turbomachine comprising a plurality of circumferentially arranged stator vanes (32), the axial position of the stator vanes (32) and/or the pitch angle circumferentially between adjacent stator vanes (32) is varied circumferentially around the stator vane assembly. The stator vane assembly reduces the pressure distortion upstream of the fan outlet stator vanes (32), reduces the circumferential pressure variation and this reduces blade forced response excitation, noise generation and aerodynamic losses.

30 Claims, 2 Drawing Sheets

STATOR VANE ASSEMBLY FOR A TURBOMACHINE

FIELD OF THE INVENTION

The present invention relates to generally to a stator vane assembly for a turbomachine, particularly to a stator vane assembly for a gas turbine engine.

Turbomachine aerofoils are susceptible to non-uniform flows generated by inlet distortion, wakes and pressure disturbances from adjacent rows of aerofoils.

BACKGROUND OF THE INVENTION

A turbofan gas turbine engine comprises a fan carrying a plurality of circumferentially spaced radially extending fan blades arranged to rotate within a fan duct defined by a fan casing. The fan casing is supported from a core engine casing by struts extending radially across the fan duct from the fan casing to the core engine casing and the engine is carried by a pylon which is secured to the core engine casing. The pressure non-uniformity is particularly strong in the fan duct due to the pylon and struts which extend radially across the fan duct and also due to a fairing for a radial drive shaft which extends radially across the fan duct and which may be located at the bottom of the gas turbine engine. These obstacles, the pylon, the struts and the fairing, generate circumferentially varying pressure levels, which may result in fan blade forced response excitation, noise generation and an increase in aerodynamic losses.

Conventionally fan outlet stator vanes are arranged axially between the pylon and the fan blades and the fan outlet stator vanes have been arranged to minimise the forcing on the fan blades.

It is known to arrange the fan outlet stator vanes such that some of them are over cambered and some of them are under cambered.

It is known from our UK patent GB1291235 to arrange the leading edges of the fan outlet stator vanes in a helical arrangement between struts.

It is known from our published UK patent application GB2046849A to arrange the fan outlet stator vanes axially upstream of the struts and to provide an asymmetric shape on the leading edge of the strut.

It is known from our published European patent application EP0942150A2 to arrange the fan outlet stator vanes between the struts, to arrange all the leading edges in the same plane and to vary the circumferential position of the fan outlet stator vanes between the struts.

It is also known from published International patent application WO9301415A to arrange alternate vanes at a first axial position and the remainder of the vanes at a second axial position.

SUMMARY OF THE INVENTION

Accordingly the present invention seeks to provide a novel stator vane assembly for a turbomachine, which reduces, preferably overcomes, the above-mentioned problems.

Accordingly the present invention provides a stator vane assembly for a turbomachine comprising a plurality of circumferentially arranged stator vanes, the axial position of the stator vanes and/or the pitch angle circumferentially between adjacent stator vanes is varied circumferentially around the stator vane assembly.

The stator vanes may be arranged at three or more axial positions and the axial positions of the stator vanes progressively changes circumferentially around the stator vane assembly from a stator vane at an upstream axial position to a stator vane at a downstream axial position.

There may be a plurality of stator vanes at the upstream axial position and a plurality of stator vanes at the downstream axial position.

There may be a plurality of stator vanes at axial positions between the upstream axial position and the downstream axial position.

The axial position of each stator vane may be within the range 20 mm axially upstream and 20 mm axially downstream of a nominal position.

Preferably the axial positions of the stator vanes vary substantially sinusoidally with circumferential position.

The stator vanes may be arranged with three or more different pitch angles between adjacent stator vanes and the pitch angles between adjacent stator vanes progressively changes circumferentially around the stator vane assembly from a maximum pitch angle between adjacent stator vane to a minimum pitch angle between adjacent stator vanes.

The stator vanes may be arranged with a plurality of maximum pitch angles between adjacent stator vanes and a plurality of minimum pitch angles between adjacent stator vanes.

There may be a plurality of different pitch angles between adjacent stator vanes.

The pitch angle between adjacent stator vanes may be within the range of 3° larger and 3° smaller than the average pitch angle between stator vanes.

Preferably the pitch angles between adjacent stator vanes vary substantially sinusoidally with circumferential position.

Preferably the stator vanes are substantially identical.

Preferably the turbomachine is a gas turbine engine comprising a compressor, a combustion chamber assembly and a turbine.

Preferably the gas turbine engine comprises a fan arranged within a fan duct defined at least partially by a fan casing, the fan comprises a plurality of fan blades, the fan casing being supported by fan outlet stator vanes, the stator vanes are fan outlet stator vanes.

Preferably the gas turbine engine comprises at least one structure extending across the fan duct, the fan outlet guide vanes being arranged between the structure and the fan blades.

The at least one structure may comprise a pylon extending across the fan duct to carry the gas turbine engine.

The at least one structure may comprise a fairing extending across the fan duct, the fairing may enclose a drive shaft extending across the fan duct.

Preferably a stator vane at a datum axial position is arranged upstream of a first structure and a stator vane at the datum axial position is arranged upstream of a second structure.

Alternatively the stator vanes are arranged with a maximum pitch angle between adjacent stator vanes arranged upstream of a first structure and a maximum pitch angle between adjacent stator vanes arranged upstream of a second structure.

The first structure comprises a pylon extending across the fan duct to carry the gas turbine engine and the second structure comprises a fairing extending across the fan duct.

The at least one structure may comprise a strut.

BRIEF DESCRIPTION OF THE DRAWINGS

The present invention will be more fully described by way of example with reference to the accompanying drawings in which.

DETAILED DESCRIPTION OF THE INVENTION

Figure 1:
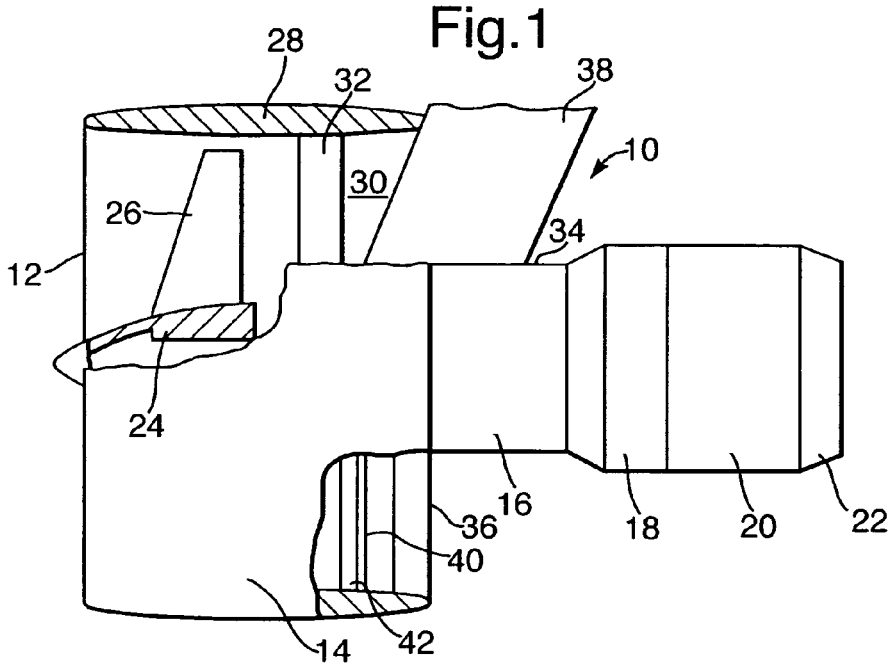
FIG. 1 shows a turbofan gas turbine engine comprising a stator vane assembly according to the present invention.

A turbofan gas turbine engine 10, as shown in FIG. 1, comprises in axial flow series an inlet 12, a fan section 14, a compressor section 16, a combustion section 18, a turbine section 20 and an exhaust 22. The turbine section 20 comprises one or more turbines (not shown) arranged to drive the fan section 14. The turbine section 20 also comprises one or more turbines (not shown) arranged to drive the compressor section 16.

The fan section 14 comprises a fan rotor 24 arranged to carry a plurality of circumferentially arranged radially outwardly extending fan blades 26. The fan section 14 also comprises a fan casing 28, which encloses the fan rotor 24 and fan blades 26 and defines at least partially a fan duct 30. A plurality of circumferentially arranged fan outlet stator vanes 32 extend radially across the fan duct 30 between the fan casing 28 and a core engine casing 34. The fan outlet stator vanes 32 direct the airflow through the fan duct 30 to the fan duct outlet 36.

A pylon 38 extends radially across the fan duct 30 and the pylon 38 is secured to the core engine casing 34 to carry the turbofan gas turbine engine 10. A drive shaft 40 extends radially across the fan duct 30 from the core engine to the fan casing 28 and the drive shaft 40 is enclosed in an aerodynamic fairing 42, which extends radially across the fan duct 28 between the fan casing 28 and the core engine casing 34. The pylon 38 and the fairing 42 are at different circumferential positions, for example the pylon 38 is at the top dead centre of the turbofan gas turbine engine 10 and the fairing 42 is at the bottom dead centre of the turbofan gas turbine engine 10.

The fan outlet stator vanes 32 are arranged axially between the fan blades 26 and the pylon 38 and the fairing 42, that is the fan outlet stator vanes 32 are arranged axially downstream of the fan blades 26 and axially upstream of the pylon 38 and the fairing 42. All the fan outlet stator vanes 32 are substantially the same, e.g. the fan outlet stator vanes have the same camber, the same stagger and the same chord.

Figure 2:
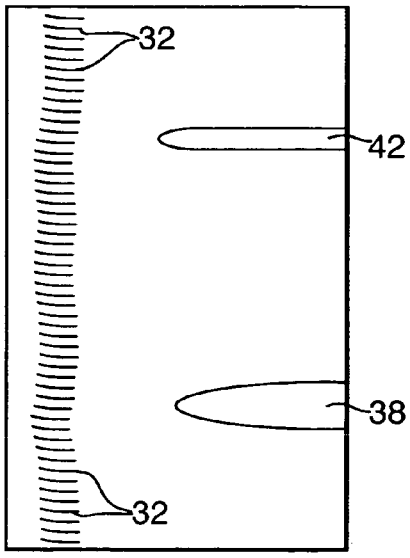
FIG. 2 shows a plan view of a stator vane assembly according to the present invention showing the optimum axial positions of the stator vanes with circumferential position.
Figure 3:
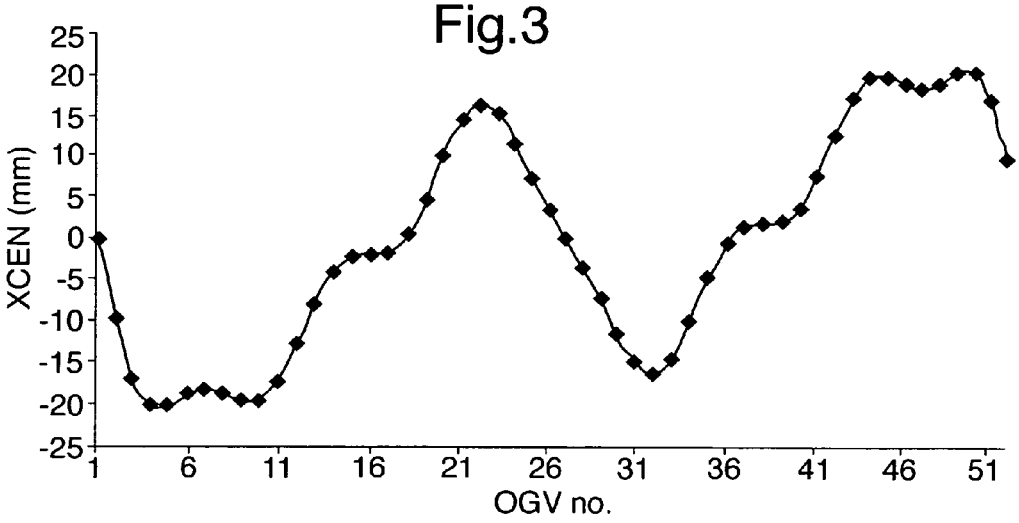
FIG. 3 is a graph showing the optimum axial positions of the stator vanes with circumferential position.

The axial position of the fan outlet stator vanes 32 is shown more clearly in FIGS. 2 and 3. Thus it can be seen that the axial positions of the fan outlet stator vanes 32 varies with the circumferential position around the turbofan gas turbine engine 10. In particular for a fan outlet stator vane assembly comprising fifty-two fan outlet stator vanes 32 the axial positions of the fan outlet stator vanes 32 was varied within the range of 20 mm upstream and 20 mm downstream of a nominal, or average or datum, axial position. The circumferential angle between adjacent fan outlet stator vanes 32 was constant at about 7°. It can be seen that the first fan outlet stator vane 32 immediately upstream of the pylon 38 is at the nominal position. The eighteenth, twenty-seventh and thirty-sixth fan outlet stator vanes 32 are also substantially at the nominal axial position. The axial positions of the second to fourth fan outlet guide vanes 32 increase up to a maximum distance of 20 mm downstream from the nominal position. The fifth to tenth fan outlet stator vanes 32 are at a distance between 18 mm and 20 mm downstream from the nominal position. The axial positions of the eleventh to seventeenth fan outlet stator vanes 32 decrease to the nominal position at the eighteenth fan outlet stator vane 32. The axial positions of the nineteenth to twenty second fan outlet stator vanes 32 increase up to a maximum distance of 16 mm upstream from the nominal position. The axial positions of the twenty third to twenty sixth fan outlet guide vanes 32 decrease to the nominal position at the twenty-seventh fan outlet guide vane 32. Similarly the axial positions of the fan outlet stator vanes 32 increase in distance in a downstream direction from the twenty-eighth to the thirty-second fan outlet stator vane 32 and then decrease back to the nominal position at the thirty-sixth fan outlet guide vane 32. Also the axial positions of the fan outlet stator vanes 32 increase in distance in an upstream direction from the thirty-seventh to the forty-fourth fan outlet stator vane 32, remain close to maximum up to the fiftieth fan outlet stator vane 32 and then decrease in distance to the nominal position. Thus it is seen that the axial positions of the fan outlet stator vanes 32 vary substantially sinusoidally with circumferential position.

Thus the fan outlet stator vanes 32 are arranged at at least three, and preferably more, axial positions and the axial positions of the fan outlet stator vanes 32 progressively changes generally sinusoidally circumferentially from a fan outlet stator vane 32 at an upstream axial position to a fan outlet stator vane 32 at a downstream axial position. Generally there is one, and preferably more, fan outlet stator vanes 32 at axial positions between the upstream axial position and the downstream axial position.

The arrangement of fan outlet stator vanes 32 shown in FIGS. 2 and 3 reduces the pressure distortion upstream of the fan outlet stator vanes 32. This also eliminates the need to have fan outlet stator vanes 32 with different cambers, e.g. under camber and over camber. The use of different axial positions of the fan outlet stator vanes 32 at different circumferential positions as shown in FIGS. 2 and 3 gave a 26% reduction in the circumferential pressure variation.

Figure 4:
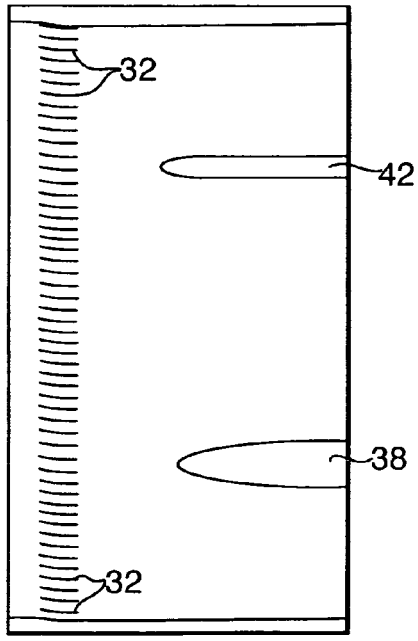
FIG. 4 shows a plan view of an alternative stator vane assembly according to the present invention showing the optimum circumferential positions of the stator vanes with circumferential position.
Figure 5:
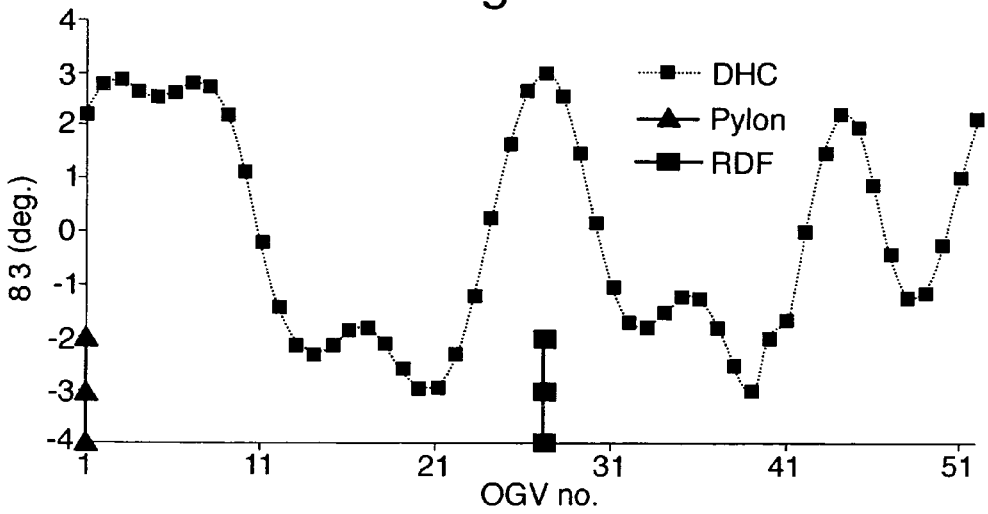
FIG. 5 is a graph showing the optimum circumferential positions of the stator vanes with circumferential position.

The circumferential pitch angle between adjacent fan outlet stator vanes 32 is shown more clearly in FIGS. 4 and 5. Thus it can be seen that the pitch angles between adjacent fan outlet stator vanes 32 varies with the circumferential position around the turbofan gas turbine engine 10. In particular for a fan outlet stator vane assembly comprising fifty-two fan outlet stator vanes 32 the pitch angles between adjacent fan outlet stator vanes 32 was varied within the range of 3° greater and 3° smaller than a nominal, or average or datum, pitch angle of 7°. The axial position of the fan outlet stator vanes 32 was constant. The first fan outlet stator vane 32 is substantially immediately upstream of the pylon. The pitch angles, or pitch distances, between the adjacent fan outlet stator vanes 32 from the first to ninth fan outlet stator vanes 32 is close to a maximum angle 2° to 3° greater than the nominal pitch angle. The pitch angles between the adjacent fan outlet stator vanes 32 decreases from the ninth to eleventh fan outlet stator vanes 32 to the nominal pitch angle at the eleventh fan outlet stator vane 32. The pitch angles between adjacent fan stator vanes 32 decreases from the eleventh to twenty-first fan outlet stator vane 32 to a minimum pitch angle of 3° less than the nominal pitch angle. The pitch angles between adjacent fan outlet stator vanes 32 increases from the twenty first to the twenty seventh fan outlet guide vane 32 to a maximum pitch angle of 3° greater than the nominal pitch angle at the twenty-seventh fan outlet guide vane 32. The twenty-seventh fan outlet guide vane 32 is substantially immediately upstream of the pylon 38. Similarly the pitch angles between adjacent fan outlet stator vanes 32 decreases from the twenty seventh fan outlet stator vane 32 to the thirty ninth fan outlet stator vane 32 to a minimum pitch angle of 3° less than the nominal angle at the thirty ninth fan outlet stator vane 32. The pitch angle between adjacent fan outlet guide vanes 32 increases from a minimum pitch angle of 3° less than the nominal pitch angle at the thirty-ninth fan outlet guide vane 32 to a pitch angle of about 2° greater than the nominal pitch angle at the forty fourth fan outlet stator vane 32. The pitch angle between adjacent fan outlet guide vanes 32 then decrease from the forty fourth fan outlet guide vane 32 to a pitch angle of about 1° less than the nominal pitch angle at the forty eighth fan outlet guide vane 32. The pitch angle between adjacent fan outlet guide vanes 32 increases from the forty-fourth to the first fan outlet stator vane 32.

Thus the fan outlet stator vanes 32 are arranged with at least three, and preferably more, different pitch angles between adjacent fan outlet stator vanes 32 and the pitch angles between adjacent fan outlet stator vanes 32 progressively changes generally sinusoidally circumferentially from a maximum pitch angle between adjacent fan outlet stator vane 32 to a minimum pitch angle between fan outlet stator vane 32. Generally there is one, and preferably more, different pitch angles between adjacent fan outlet stator vanes 32.

The arrangement of fan outlet stator vanes 32 shown in FIGS. 4 and 5 reduces the pressure distortion upstream of the fan outlet stator vanes 32. This also eliminates the need to have fan outlet stator vanes with different cambers, e.g. under camber and over camber. The use of different pitch angles, or pitch distances, between adjacent fan outlet stator vanes 32 at different circumferential positions as shown in FIGS. 4 and 5 gave a 12% reduction in the circumferential pressure variation and a reduction in fan blade forcing.

Although the present invention has been described with reference to stator vanes axially between a pylon and/or a radial drive shaft fairing and the fan blades the present invention is equally applicable to the use of stator vanes between the fan blades and any number of other structures, e.g. struts, producing distortions, disturbances etc and it is equally applicable to the use of stator vanes between compressor blades and any number of structures producing distortions, disturbances etc.

I claim:

1. A stator vane assembly for a turbomachine comprising a plurality of circumferentially arranged stator vanes, the turbomachine comprising a rotor arranged within a duct defined at least partially by a casing, the rotor comprises a plurality of rotor blades, at least one structure extending across the duct, the stator vanes being arranged between the structure and the rotor blades, the pitch angle circumferentially between adjacent stator vanes being varied circumferentially around the stator vane assembly wherein the stator vanes are arranged with three or more different pitch angles between adjacent stator vanes and the pitch angles between adjacent stator vanes progressively changes circumferentially around the stator vane assembly from a maximum pitch angle between adjacent stator vanes to a minimum pitch angle between adjacent stator vanes wherein the stator vanes are arranged with a plurality of maximum pitch angles between adjacent stator vanes and a plurality of minimum pitch angles between adjacent stator vanes.

2. A stator vane assembly for a turbomachine as claimed in claim 1 wherein the stator vanes are arranged with a maximum pitch angle between adjacent stator vanes arranged upstream of a first structure and a maximum pitch angle between adjacent stator vanes arranged upstream of a second structure.

3. A stator vane assembly for a turbomachine as claimed in claim 2 wherein the first structure comprises a pylon extending across the fan duct to carry the gas turbine engine and the second structure comprises a fairing extending across the fan duct.

4. A stator vane assembly for a turbomachine as claimed in claim 1 wherein there are a plurality of different pitch angles between adjacent stator vanes.

5. A stator vane assembly for a turbomachine as claimed in claim 1 wherein the pitch angle between adjacent stator vanes is within the range of 3° larger and 3° smaller than the average pitch angle between stator vanes.

6. A stator vane assembly for a turbomachine as claimed in claim 1 wherein the pitch angles between adjacent fan outlet stator vanes vary substantially sinusoidally with circumferential position.

7. A stator vane assembly for a turbomachine as claimed in claim 1 wherein the stator vanes are substantially identical.

8. A stator vane assembly for a turbomachine as claimed in claim 1 wherein the turbomachine is a gas turbine engine comprising a compressor, a combustion chamber assembly and a turbine.

9. A stator vane assembly for a turbomachine as claimed in claim 8 wherein the gas turbine engine comprises a fan arranged within a fan duct defined at least partially by a fan casing, the fan comprises a plurality of fan blades, the fan casing being supported by fan outlet stator vanes, the stator vanes are fan outlet stator vanes.

10. A stator vane assembly for a turbomachine as claimed in claim 9 wherein the gas turbine engine comprises at least one structure extending across the fan duct, the fan outlet guide vanes being arranged between the structure and the fan blades.

11. A stator vane assembly for a turbomachine as claimed in claim 10 wherein the at least one structure comprises a pylon extending across the fan duct to carry the gas turbine engine.

12. A stator vane assembly for a turbomachine as claimed in claim 10 wherein the at least one structure comprises a fairing extending across the fan duct.

13. A stator vane assembly for a turbomachine as claimed in claim 12 wherein the fairing encloses a drive shaft extending across the fan duct.

14. A stator vane assembly for a turbomachine comprising a plurality of circumferentially arranged stator vanes, the turbomachine comprising a rotor arranged within a duct defined at least partially by a casing, the rotor comprising a plurality of rotor blades, at least one structure extending across the duct, the stator vanes being arranged between the structure and the rotor blades, the axial position of the stator vanes being varied circumferentially around the stator vane assembly, the stator vanes being arranged at three or more axial positions, the axial positions of the stator vanes progressively changes circumferentially around the stator vane assembly from a stator vane at an upstream axial position to a stator vane at a downstream axial position, and a plurality of stator vanes at the upstream axial position and a plurality of stator vanes at the downstream axial position.

15. A stator vane assembly for a turbomachine as claimed in claim 14 wherein a stator vane at a datum axial position is arranged upstream of a first structure and a stator vane at the datum axial position is arranged upstream of a second structure.

16. A stator vane assembly for a turbomachine as claimed in claim 15 wherein the first structure comprises a pylon extending across the fan duct to carry the gas turbine engine and the second structure comprises a fairing extending across the fan duct.

17. A stator vane assembly for a turbomachine as claimed in claim 14 wherein there are a plurality of stator vanes at axial positions between the upstream axial position and the downstream axial position.

18. A stator vane assembly for a turbomachine as claimed in claim 14, wherein the axial position of each stator vane is within the range 20 mm axially upstream and 20 mm axially downstream of a nominal position.

19. A stator vane assembly for a turbomachine as claimed in claim 14 wherein the axial positions of the stator vanes vary substantially sinusoidally with circumferential position.

20. A stator vane assembly for a turbomachine as claimed in claim 14 wherein the stator vanes are substantially identical.

21. A stator vane assembly for a turbomachine as claimed in claim 14 wherein the turbomachine is a gas turbine engine comprising a compressor, a combustion chamber assembly and a turbine.

22. A stator vane assembly for a turbomachine as claimed in claim 21 wherein the gas turbine engine comprises a fan arranged within a fan duct defined at least partially by a fan casing, the fan comprises a plurality of fan blades, the fan casing being supported by fan outlet stator vanes, the stator vanes are fan outlet stator vanes.

23. A stator vane assembly for a turbomachine as claimed in claim 22 wherein the gas turbine engine comprises at least one structure extending across the fan duct, the fan outlet guide vanes being arranged between the structure and the fan blades.

24. A stator vane assembly for a turbomachine as claimed in claim 23 wherein the at least one structure comprises a pylon extending across the fan duct to carry the gas turbine engine.

25. A stator vane assembly for a turbomachine as claimed in claim 23 wherein the at least one structure comprises a fairing extending across the fan duct.

26. A stator vane assembly for a turbomachine as claimed in claim 25 wherein the fairing encloses a drive shaft extending across the fan duct.

27. A fan outlet stator vane assembly for a turbofan gas turbine engine comprising a plurality of circumferentially arranged fan outlet stator vanes, the turbofan gas turbine engine comprising a fan rotor arranged within a fan duct defined at least partially by a fan casing, the fan rotor comprising a plurality of fan rotor blades, a pylon extending across the fan duct to carry the turbofan gas turbine engine and a fairing extending across the fan duct, the fan outlet stator vanes being arranged between the pylon and the fairing and the fan rotor blades, the fan outlet guide vanes being arranged downstream of the fan rotor blades and upstream of the pylon and the fairing, the pitch angle circumferentially between adjacent fan outlet stator vanes being varied circumferentially around the fan outlet stator vane assembly, the fan outlet stator vanes being arranged with three or more different pitch angles between adjacent fan outlet stator vanes, the pitch angles between adjacent fan outlet stator vanes progressively changes circumferentially around the fan outlet stator vane assembly from a maximum pitch angle between adjacent fan outlet stator vanes to a minimum pitch angle between adjacent fan outlet stator vanes and the fan outlet stator vanes being arranged with a plurality of maximum pitch angles between adjacent fan outlet stator vanes and a plurality of minimum pitch angles between adjacent fan outlet stator vanes.

28. A fan outlet stator vane assembly as claimed in claim 27 wherein the fan outlet stator vanes are arranged with a maximum pitch angle between adjacent fan outlet stator vanes arranged upstream of the pylon and a maximum pitch angle between adjacent fan outlet stator vanes arranged upstream of the fairing.

29. A fan outlet stator vane assembly for a turbofan gas turbine engine comprising a plurality of circumferentially arranged fan outlet stator vanes, the turbofan gas turbine engine comprising a fan rotor arranged within a fan duct defined at least partially by a fan casing, the fan rotor comprising a plurality of fan rotor blades, a pylon extending across the fan duct to carry the turbofan gas turbine engine and a fairing extending across the fan duct, the fan outlet stator vanes being arranged between the pylon and the fairing and the fan rotor blades, the fan outlet guide vanes being arranged downstream of the fan rotor blades and upstream of the pylon and the fairing, the axial position of the fan outlet stator vanes being varied circumferentially around the fan outlet stator vane assembly, the fan outlet stator vanes being arranged at three or more axial positions, the axial positions of the fan outlet stator vanes progressively changes circumferentially around the fan outlet stator vane assembly from a fan outlet stator vane at an upstream axial position to a fan outlet stator vane at a downstream axial position, a plurality of fan outlet stator vanes at the upstream axial position and a plurality of fan outlet stator vanes at the downstream axial position.

30. A fan outlet stator vane assembly as claimed in claim 29 wherein a fan outlet stator vane at a datum axial position is arranged upstream of the pylon and a fan outlet stator vane at the datum axial position is arranged upstream of the fairing.

* * * * *